United States Patent [19]

Gilman et al.

[11] 4,420,853

[45] Dec. 20, 1983

[54] SCRUB BRUSH

[75] Inventors: Thomas Gilman, Woodstock, Ill.; Frank N. Miller, Racine, Wis.

[73] Assignee: The Kendall Company, Boston, Mass.

[21] Appl. No.: 324,748

[22] Filed: Nov. 25, 1981

[51] Int. Cl.[3] ..... A46B 9/00

[52] U.S. Cl. ..... 15/111; 15/106; 15/160; 15/167 B; 15/145

[58] Field of Search ..... 15/159 R, 159 A, 160, 15/106, 114, 117, 145, 161, 167 B, DIG. 5, 111, 105; D4/6, 14; 132/75.3; 401/28

[56] References Cited

U.S. PATENT DOCUMENTS

| | | | |
|---|---|---|---|
| D. 25,518 | 5/1896 | Young | 15/106 |
| 180,717 | 8/1876 | Isaacs | 15/DIG. 5 |
| D. 236,564 | 9/1975 | Kaufman | D4/6 |
| D. 242,668 | 12/1976 | Kaufman | D4/17 |
| 3,467,978 | 9/1969 | Golden | 132/75.3 |
| 3,556,667 | 1/1971 | Kaufman | 401/28 |
| 3,924,286 | 12/1975 | Miller | 15/159 A X |

FOREIGN PATENT DOCUMENTS

| | | | |
|---|---|---|---|
| 583957 | 9/1959 | Canada | 15/DIG. 5 |
| 1231664 | 1/1967 | Fed. Rep. of Germany | 15/160 |
| 141491 | 8/1930 | Switzerland | D4/8 |
| 225048 | 11/1924 | United Kingdom | 15/167 B |
| 438333 | 11/1935 | United Kingdom | 15/106 |
| 515233 | 11/1939 | United Kingdom | 15/106 |

*Primary Examiner*—Edward L. Roberts

*Attorney, Agent, or Firm*—Powell L. Sprunger

[57] ABSTRACT

A scrub brush comprising, a housing having a base, a back side, a front side, a pair of opposed sides extending between the back side and front side, and a forward portion extending from the base on the front side at an acute angle relative to the base. The base has a plurality of bristles extending from a lower surface of the base, and the forward portion has a plurality of bristles extending outwardly from the forward portion.

6 Claims, 7 Drawing Figures

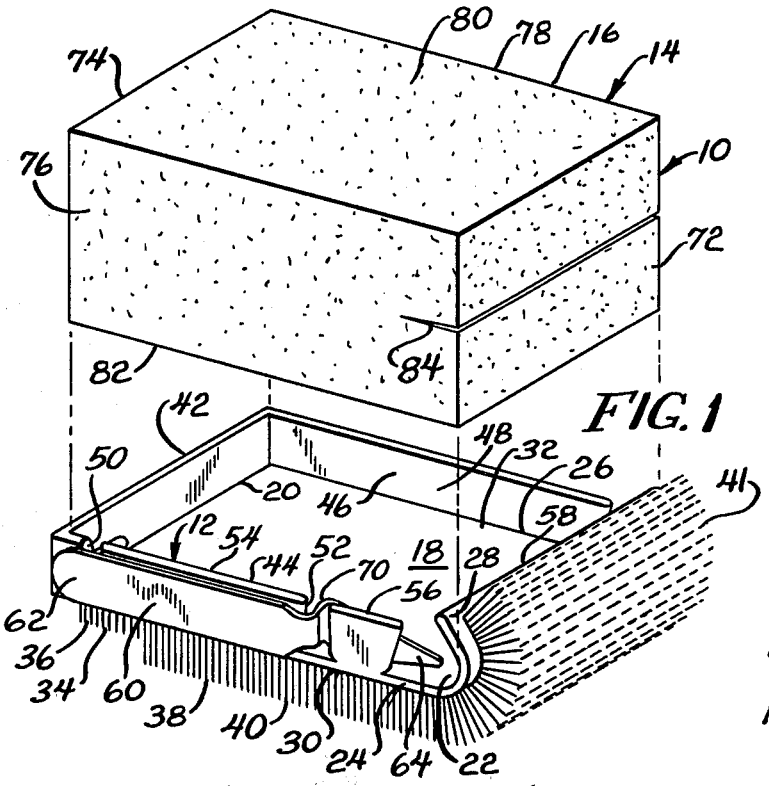
FIG. 1
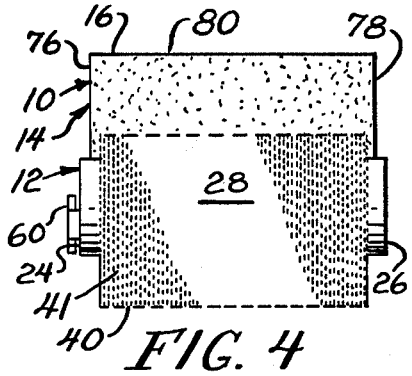
FIG. 4
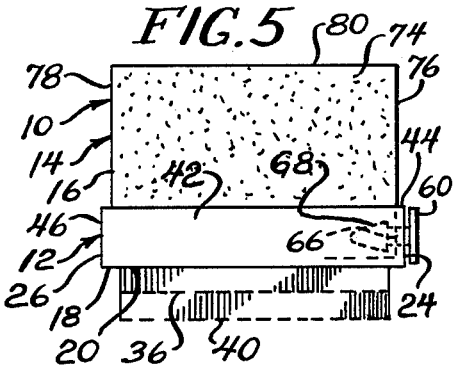
FIG. 5
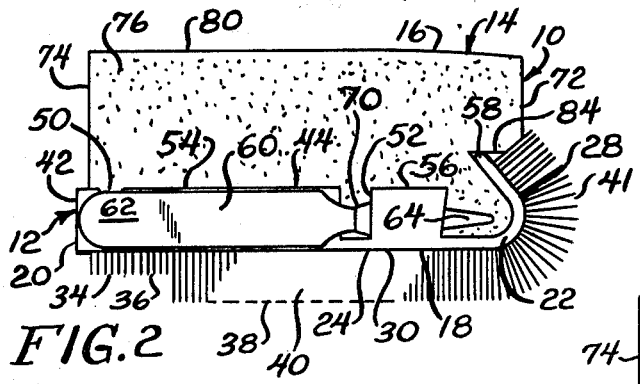
FIG. 2
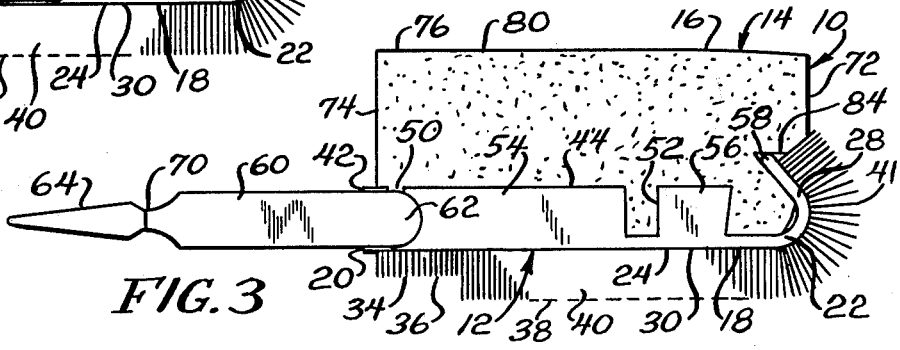
FIG. 3
FIG. 6
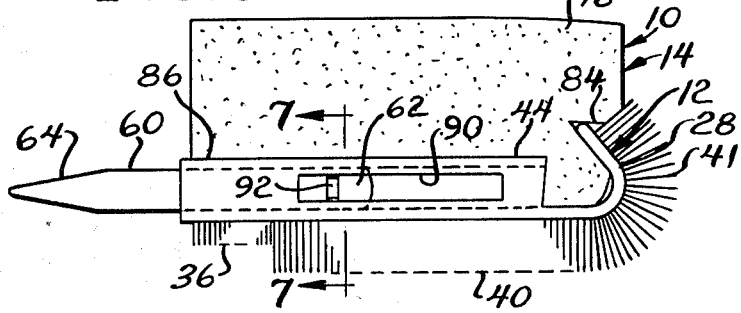
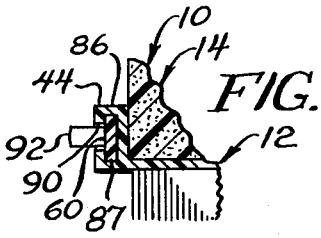
FIG. 7

SCRUB BRUSH

BACKGROUND OF THE INVENTION

The present invention relates to scrub brushes.

Before a surgical procedure in an operating room, the surgeon and assistant, such as the scrub nurse, scrub their hands and arms with an antimicrobial solution, such as povidone iodine, prior to donning surgical gloves. An assortment of scrub brushes have been utilized for the scrubbing procedure, but these brushes have been deficient in certain respects. Initially, it has proven difficult to scrub between the fingers with prior brushes. Also, the prior brushes have not provided for convenient and adequate scrubbing beneath the fingernails. Although some brushes have been provided with loose separate picks, the picks frequently become lost down the drain, and such picks are difficult to hold during use.

SUMMARY OF THE INVENTION

A principal feature of the present invention is the provision of an improved scrub brush.

The scrub brush of the invention comprises, a housing having a base, a back side, a front side, a pair of opposed sides extending between the back side and front side, and a forward portion extending from the base on the front side at an acute angle relative to the base. The base has a plurality of bristles extending from a lower surface of the base.

A feature of the present invention is that the forward portion has a plurality of bristles extending outwardly from the forward portion.

Another feature of the invention is that the bristles on the forward portion facilitate cleaning between the user's fingers.

Yet another feature of the invention is that the brush has a pick positioned on the housing being movable between a first storage position with the pick located adjacent the housing, and a second operative position with the pick extending outwardly from the housing.

Another feature of the invention is that the pick may be utilized to clean the fingernails of the user in the operative position of the pick.

A further feature of the invention is that the base has a lateral area of relatively short bristles adjacent the back side of the housing, with substantially the remainder of the base having a region of relatively large bristles.

Still another feature of the invention is that the relatively small bristles may be utilized to clean the fingernails of the user.

Further features will become more fully apparent in the following description of the embodiments of this invention and from the appended claims.

DESCRIPTION OF THE DRAWINGS

In the drawings

FIG. 1 is an exploded perspective view illustrating a scrub brush of the present invention;

FIG. 2 is a side elevational view of the brush with a pick of the brush being located in a storage position;

FIG. 3 is a side elevational view of the brush illustrating the pick located in an extended operative position;

FIG. 4 is a front plan view of the brush of the present invention;

FIG. 5 is a rear plan view of the brush of the present invention;

FIG. 6 is a side elevational view of another embodiment of the brush of the present invention with a pick of the brush being located in an operative position; and embodiment of the brush of the present invention with a pick of the brush being located in an operative position; and FIG. 7 is a fragmentary sectional view taken substantially as indicated along the line 7—7 of FIG. 6.

DESCRIPTION OF THE PREFERRED EMBODIMENTS

Referring now to FIGS. 1–5, there is shown a scrub brush generally designated 10 of the invention comprising a housing 12 of suitable plastic material, such as polyethylene, and a handle member 14 comprising a rectangular block 16 of suitable foam material, such as polyurethane foam.

The housing 12 has a rectangular base 18, a back side 20, a front side 22, and a pair of opposed sides 24 and 26 extending between the back side 20 and the front side 22. The housing 12 has a forward portion 28 extending from the base 18 on the front side 22 at an acute angle, such as between 60 and 70 degrees relative to the base 18. The base 18 has a lower surface 30, and an opposed upper surface 32. As shown, the base 18 has a lateral area 34 of relatively short bristles 36, such as 7 mm. in length, extending from the lower surface 30 adjacent the back side 20. Also, the base 18 has a region 38 over substantially the remainder of the base 18 of relatively long bristles 40, such as 12 mm. in length, extending from the lower surface 30 of the base 18. The forward portion 28 has relatively long bristles 41, such as 12 mm. in length, extending outwardly from the forward portion 28, with the bristles 41 on the forward portion 28 preferably having a length approximately equal the length of the bristles 40 in the region 38 of the base 18.

The housing 12 has an upstanding back wall 42 adjacent the back side 20, an upstanding sidewall 44 adjacent the side 24, and an upstanding sidewall 46 adjacent the side 26. The back wall 42 and sidewalls 44 and 46 define a cavity 48 of a size to snugly receive the block 16 of foam on the upper surface 32 of the base 18. The sidewall 44 has a first vertical slot 50 adjacent the back side 20, and a second vertical slot 52 located a substantial distance forward of the back side 20 of the housing 12. The second slot 52 defines a rear portion 54 of the sidewall 44, and a forward portion 56 of the sidewall 44.

The brush 10 has an elongated pick 60 having an inner end 62, and a tapered outer end 64. The pick 60 has a post 66 pivotally received in the first slot 50, and an enlarged portion 68 at an outer end of the post 66 to retain the post 66 within the first slot 50. The pick 60 has a bent portion 70 removably received in the second slot 52 in a first storage position of the pick 60, as shown in FIG. 2. In this configuration, the pick inner end 62 is located over the outer surface of the rear sidewall portion 54, while the outer end 64 of the pick 60 is received over an inner surface of the sidewall forward portion 56. Thus, in this configuration, the pick 60 may be placed in the storage position with the pick 60 located adjacent the housing 12. However, the pick 60 may be pivotally moved to a second operative or extended position, as shown in FIG. 3, with the outer end 64 of the pick 60 extending outwardly from the housing 12.

The block 16 of foam has a front side 72, a back side 74 generally parallel to the front side 72, a pair of opposed generally parallel sides 76 and 78 extending between the front side 72 and back side 74, a top 80, and a bottom 82 generally parallel to the top 80. The block 16 is dimensioned to be received in the cavity 48 with the bottom 82 of the block 16 facing and engaging the upper surface 32 of the base 18, and with an outer edge 58 of the forward portion 28 received in a lateral slit 84 in the front side 72 of the block 16. In this manner, the block 16 receives an outer part of the forward portion 28 in order to retain the block 16 in place on the housing 12 without the use of adhesive.

In use, an antimicrobial solution, such as povidone iodine, may be placed in the absorbent block 16 of foam for use in scrubbing the hands and arms of a user. The handle member 14 and housing 12 may be grasped by the user's hand in order to scrub the user's hands and arms. The short bristles 36 on the base 18 may be utilized to scrub the fingernails of the user, while the long bristles 41 on the forward portion 28 may be utilized to scrub between the fingers. The long bristles 40 in the region 38 of the base 18 may be utilized to scrub the remainder of the fingers, hands, and arms of the user during the scrubbing procedure. Also, the pick 60 may be pivoted to the second operative position, as shown in FIG. 3, to clean beneath the user's fingernails through use of the outer tapered pick end 64. The remaining portion of the scrubbing procedure may take place with the pick 60 located in the first storage position, as shown in FIG. 2.

Another embodiment of the present invention is illustrated in FIGS. 6 and 7, in which like reference numerals designate like parts. In this embodiment, the sidewall 44 has an elongated tunnel 86 defining a groove 87 to slidably receive the pick 60. The tunnel 86 has an elongated outer slot 90, and the pick 60 has an outwardly directed tab 92 adjacent the inner end 62 received in the slot 90. The tab 92 of the pick 60 is utilized to manipulate the pick 60 between a storage position with the pick 60 received in the tunnel 86, and an outer position with the outer end 64 of the pick 60 extending from the housing 12 for use in cleaning beneath the fingernails. Thus, the pick 60 may be slidably moved between the first storage position with the outer end 64 received in the tunnel 86, and the second operative or extended position with the outer pick end 64 exposed for use in the scrubbing procedure. In other respects, the brush 10 of FIGS. 6 and 7 is similar in construction and use to the brush 10 of FIGS. 1–5.

The foregoing detailed description is given for clearness of understanding only, and no unnecessary limitations should be understood therefrom, as modifications will be obvious to those skilled in the art.

I claim:

1. A scrub brush comprising, a housing having a base, a back side, a front side, a pair of opposed sides extending between the back side and front side, and a forward portion extending from the base on the front side at an acute angle relative to the base, said base having a plurality of bristles extending from a lower surface of the base, and said forward portion having a plurality of bristles extending outwardly from the forward portion, including a handle member positioned on an upper surface of the base, wherein the housing includes an upstanding back wall on the back side, and a pair of opposed upstanding sidewalls on the opposed sides and connected to the back wall, said walls defining a cavity to receive said handle member, and wherein the handle member comprises a block of foam received in the cavity.

2. The brush of claim 1 wherein the base has a lateral area of relatively small bristles adjacent the back side of the housing, and a region over substantially the remainder of the base of relatively long bristles.

3. The brush of claim 2 wherein the length of the bristles on the forward portion are approximately the length of the bristles in said region.

4. The brush of claim 1 including a pick having an outer tapered end, and means for mounting the pick on the housing for movement between a first storage position and a second operative position with said outer end exposed.

5. The brush of claim 1 wherein the angle between the forward portion and the base is in the range of 60 to 70 degrees.

6. A scrub brush comprising, a housing having a base, a back side, a front side, a pair of opposed sides extending between the back side and front side, and a forward portion extending from the base on the front side at an acute angle relative to the base, said base having a plurality of bristles extending from a lower surface of the base, and said forward portion having a plurality of bristles extending outwardly from the forward portion, including a handle member positioned on an upper surface of the base, wherein the handle member comprises a block of foam, and wherein said foam block includes a lateral slit on the front side to receive an outer edge of said forward portion.

* * * * *